US005944603A

United States Patent [19]

Guinn et al.

[11] Patent Number: 5,944,603

[45] Date of Patent: Aug. 31, 1999

[54] ROTATING RADIATOR SCREEN FOR CROP HARVESTER

[75] Inventors: Ronald K. Guinn, Valley Center; Michael L. O'Halloran, Hesston, both of Kans.

[73] Assignee: Hay & Forage Industries, Hesston, Kans.

[21] Appl. No.: 08/896,869

[22] Filed: Jul. 18, 1997

[51] Int. Cl.[6] ..... A01F 12/00; F16J 15/32

[52] U.S. Cl. ..... 460/100; 277/549; 55/385.3

[58] Field of Search ..... 460/119, 100, 460/117; 56/DIG. 8; 277/549, 562, 572; 55/269, 290, 285.3, 400

[56] References Cited

U.S. PATENT DOCUMENTS

| | | | |
|---|---|---|---|
| 1,193,702 | 8/1916 | Krun . | |
| 1,206,025 | 11/1916 | Nuckles . | |
| 1,475,062 | 11/1923 | Fulk . | |
| 2,455,734 | 12/1948 | Clausen . | |
| 2,854,086 | 12/1958 | Schmidt . | |
| 3,087,563 | 4/1963 | Fisher . | |
| 3,309,847 | 3/1967 | Donaldson . | |
| 3,404,514 | 10/1968 | Fergason . | |
| 3,565,203 | 2/1971 | Ashton et al. . | |
| 3,630,003 | 12/1971 | Ashton et al. . | |
| 3,639,016 | 2/1972 | Bourgeois | 277/549 X |
| 3,837,149 | 9/1974 | West et al. . | |
| 3,938,586 | 2/1976 | Barlow et al. . | |
| 4,153,436 | 5/1979 | Cozine et al. . | |
| 4,233,040 | 11/1980 | Vogelaar et al. . | |
| 4,299,603 | 11/1981 | Friesen . | |
| 4,439,218 | 3/1984 | Priepke et al. . | |
| 4,443,236 | 4/1984 | Peiler . | |
| 4,542,785 | 9/1985 | Bagnall et al. . | |
| 4,874,411 | 10/1989 | Snauwaert et al. . | |
| 4,906,262 | 3/1990 | Nelson et al. . | |
| 4,934,449 | 6/1990 | Watt et al. . | |
| 5,006,135 | 4/1991 | Friesen . | |
| 5,183,487 | 2/1993 | Lodico et al. . | |
| 5,456,475 | 10/1995 | Abraham et al. | 277/562 X |

*Primary Examiner*—Terry Lee Melius
*Attorney, Agent, or Firm*—Hovey, Williams, Timmons & Collins

[57] ABSTRACT

A self-propelled farm machine includes a rotatable air inlet screen assembly having a rotatable member and a surrounding contact surface with a positive seal therebetween. The preferred seal is composed of flexible, resilient material and includes a body portion circumscribing the rotatable member and in sealing engagement therewith, a disk-shaped skirt circumscribing the body portion and flexed into wiping engagement with the contact surface, and a transition section therebetween.

16 Claims, 3 Drawing Sheets

ROTATING RADIATOR SCREEN FOR CROP HARVESTER

BACKGROUND OF THE INVENTION

1. Field of the Invention

The present invention relates to the field of self-propelled farm machines of the type having a rotatable air inlet screen assembly. More particularly, the invention is concerned with a seal apparatus for providing a positive seal between the rotatable member of the screen assembly and a surrounding contact surface.

2. Description of the Prior Art

During the operation of farm machines such as tractors and self-propelled harvesters, air-borne debris may be induced onto the engine radiator thereby affecting its cooling capacity. To correct this, the prior art discloses rotating air inlet screen assemblies that filter debris from the radiator air stream.

There has been a problem, however, in providing a seal between the rotating member and the body of the machine. One prior art solution has been to provide outward air flow in the area between the rotating member and the vehicle body. Another solution has been to provide brushes in this area. These solutions, however, do not provide a positive air seal between the rotating member and the farm machine body.

SUMMARY OF THE INVENTION

The present invention solves the prior art problems discussed above and provides a distinct advance in the state of the art. In particular, the seal apparatus hereof provides a positive air seal between the rotating member of a rotating screen assembly and a surrounding contact surface of the farm machine body.

The preferred seal apparatus includes a body portion with sufficient length to circumscribe the rotatable member of the screen assembly, a skirt extending along the length of the body portion, and a transition section therebetween. In combination with a farm machine, the seal apparatus circumscribes the rotatable member and is clamped in place with the ends abutting one another. The inboard surface of the body portion engages and provides a positive seal with the rotatable member. In forming the body portion about the rotatable member, the skirt flexes into wiping engagement with a surrounding contact surface and provides a positive seal therewith. Other preferred aspects of the invention are disclosed herein.

DETAILED DESCRIPTION OF THE PREFERRED EMBODIMENT

Figure 1:
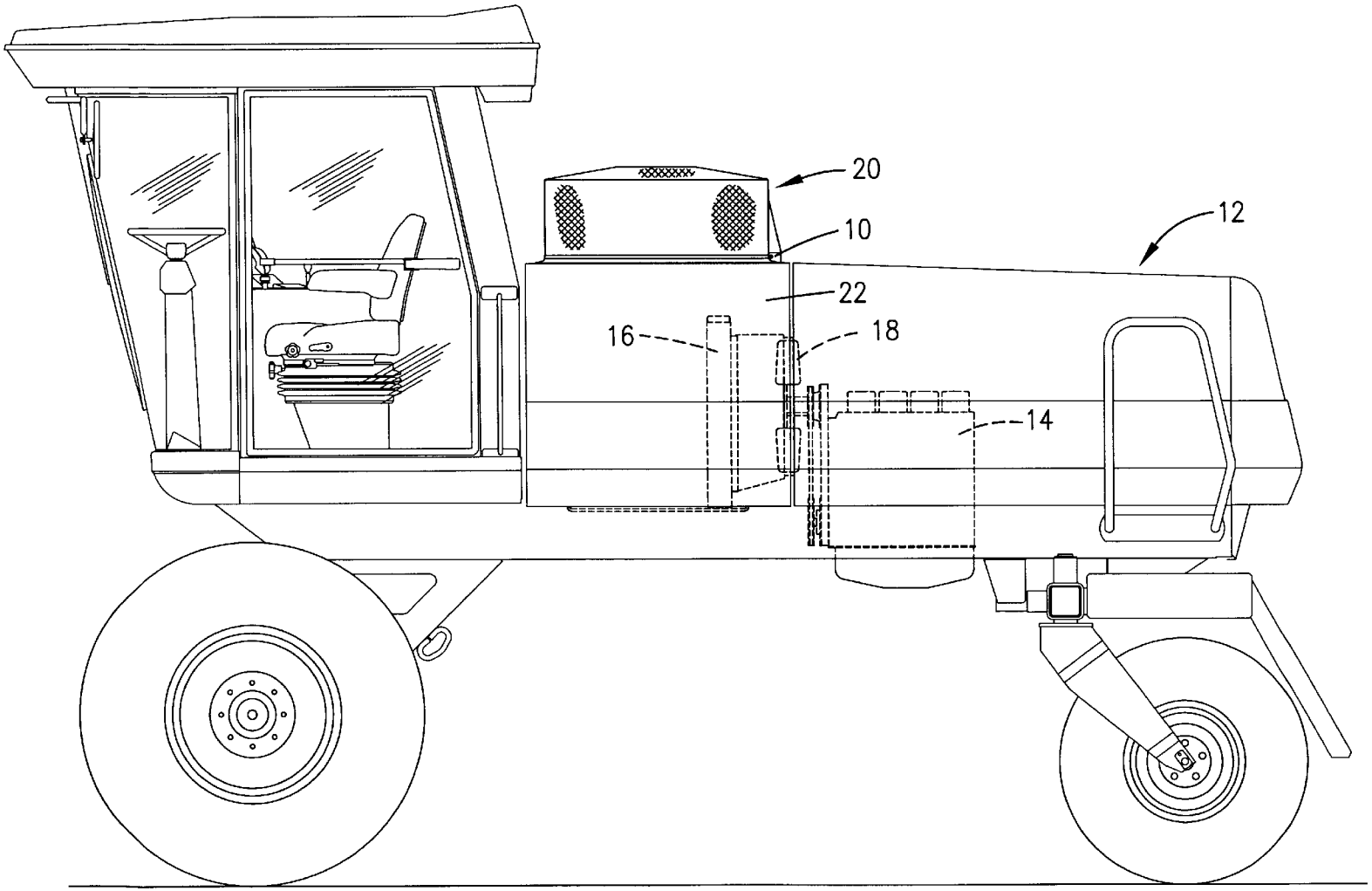
FIG. 1 is a side elevational view of the preferred seal apparatus in accordance with the present invention shown in combination with a farm machine.

FIG. 1 illustrates preferred seal apparatus 10 in combination with a farm machine 12 such as a tractor in accordance with the present invention. In pertinent part, machine 12 includes engine 14, radiator 16, radiator fan 18, screen assembly 20, and air inlet housing 22 which channels inlet air as induced by the operation of fan 18 through assembly 20 and radiator 16.

Figure 2:
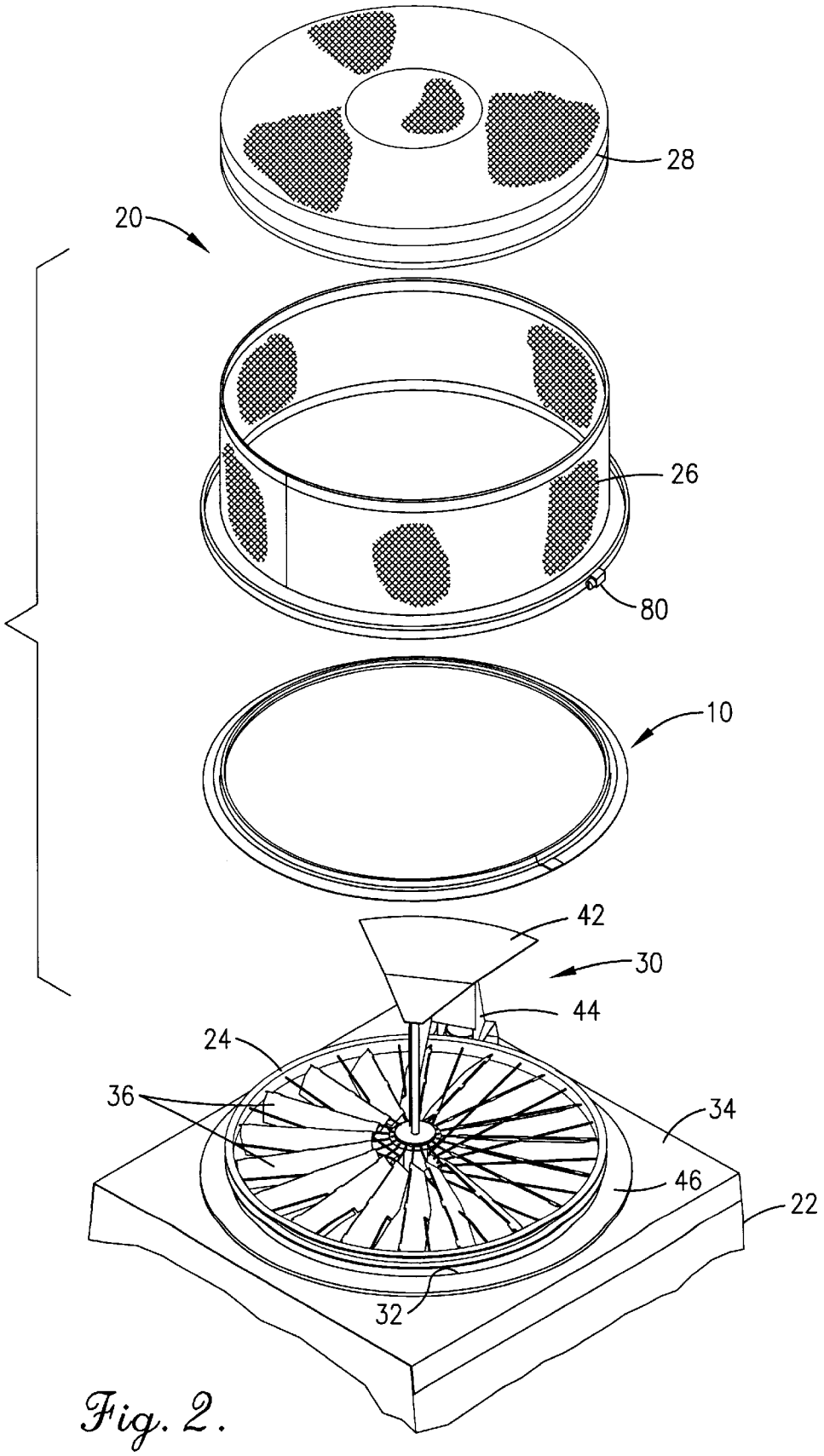
FIG. 2 is a partial exploded view of the rotatable air inlet assembly of FIG. 1.

As shown in FIG. 2, screen assembly 20 includes rotatable member 24, tubular side screen 26, top screen 28 and cleaning assembly 30. Seal apparatus 10 is positioned between side screen 26 and rotatable member 24 as discussed further herein.

Rotatable member 24 is preferably in the nature of a bicycle wheel rotatably mounted in a corresponding opening 32 defined in top wall 34 of housing 22. Rotation blades 36 are positioned in the spokes of member 24. Radiator fan 18 induces air flow downwardly through member 24 and across blades 36 which causes rotation of member 24 and thereby rotation of screen assembly 20.

Figure 4:
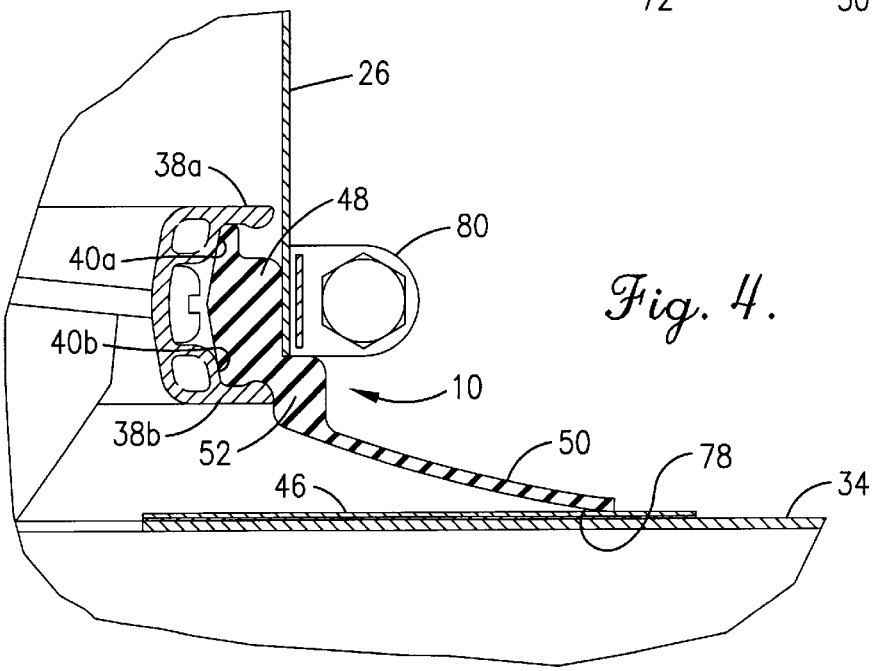
FIG. 4 is a partial sectional view of the screen assembly of FIG. 1.

As best shown in FIG. 4, the periphery of rotatable member 24 includes spaced, outwardly extending, wheel rims 38*a* and 38*b*, and spaced ledges 40*a* and 40*b* extending inwardly from rims 38*a,b* respectively and recessed from the outer edges thereof.

Cleaning assembly 30 is conventional in nature and includes baffle 42 and vacuum nozzle 44 connected to the area between radiator 16 and fan 18. This induces a partial vacuum in nozzle 44 during operation. Baffle 42 is positioned adjacent the interior faces of screens 26,28 and prevents air flow through the adjacent portions thereof. This releases debris from the outer faces of these portions for removal by nozzle 44.

Top wall 34 of housing 22 includes a contact surface in the nature of an annular, stainless steel wearplate 46 surrounding opening 32 and thereby surrounding rotatable member 24.

Figure 3:
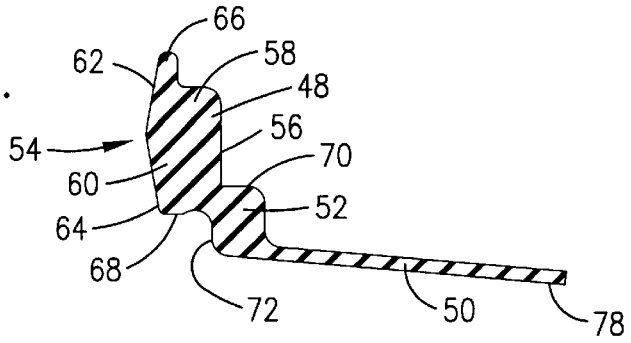
FIG. 3 is a cross-sectional view of the preferred seal apparatus before installation on a farm machine.
Figure 5:
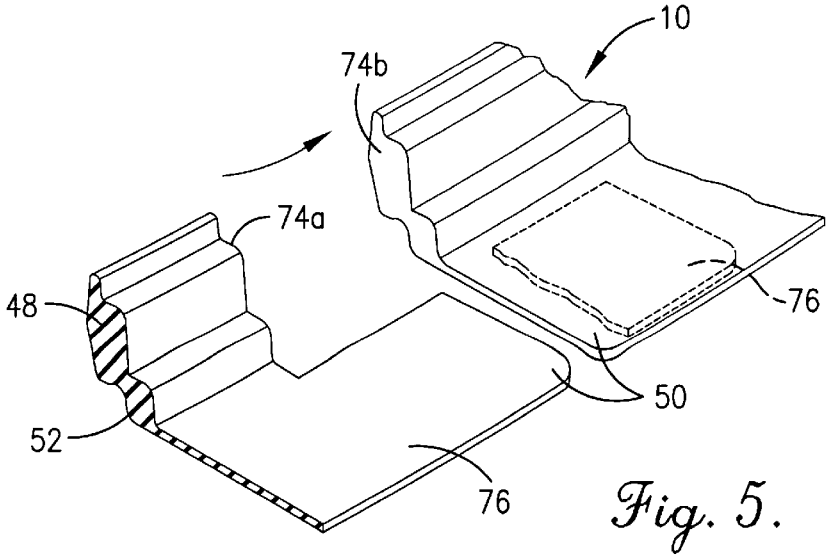
FIG. 5 is a partial pictorial view of the preferred seal apparatus illustrating the joining of the ends.

Referring to FIGS. 3–5, seal apparatus 10 is preferably an extruded construct composed of 60 durometer EPDM rubber presenting a length sufficient to circumscribe rotatable member 24, although other materials may be utilized to form the seal apparatus 10, such as polyurethane or a relatively harder rubber. FIG. 3 illustrates apparatus 10 in profile before installation about rotatable member 24. Seal apparatus 10 integrally includes body portion 48, planar skirt 50 extending along the length of body portion 48, and transition section 52 therebetween.

Body portion 48 presents inboard surface 54, outboard surface 56 and includes upper portion 58 and lower portion 60. Upper portion 58 presents upper inboard surface 62, and lower portion 60 presents lower inboard surface 64. Surfaces 62, 64 are sloped in order to conform to the slopes of ledges 40*a,b* respectively as shown in FIG. 4. Upper portion 58 also includes upstanding bead 66 and lower surface 68.

Transition section 52 extends outwardly and downwardly from lower portion 60 of body portion 48 as viewed in FIGS. 3 and 4. Transition section 52 presents shelf 70 and inboard face 72.

Skirt 50 extends outwardly from the lower area of transition section 52 at an angle of about 5° below horizontal as viewed in FIG. 3, that is, at an angle of about 95° relative to outboard surface 56 of body portion 48.

Referring to FIG. 4, apparatus 10 is installed by inserting body portion 48 between rims 38*a,b* until upper and lower inboard surfaces 62, 64 engage and thereby seal against ledges 40*a,b* respectively. In this position, bead 66 engages and seals with the interior of rim 38*a* and lower surface 68 engages and seals with the interior of rim 38*b*. Also, inboard face 72 of transition section 52 engages and seals with the periphery of rim 38*b*. In this way, a positive seal is achieved between seal body portion 48 and rotatable member 24.

As illustrated in FIG. 5, seal apparatus 10 presents opposed ends 74*a* and 74*b*. At end 74*a*, body portion 48, transition section 52 and a portion of skirt 50 are cut to present skirt flap 76. During installation around rotatable member 24, ends 74*a,b* are abutted with skirt flap 76 overlapping and adhered to that portion of skirt 50 adjacent end 74*b*, as illustrated by the phantom lines in FIG. 5.

During the installation process, skirt 50 flexes toward and into contact with wearplate 46 to present an angle between about 15° and 20° below horizontal as viewed in FIG. 4, that is, between about 105° and 110° relative to outboard surface 56. This flexing occurs because the circumference of skirt 50 is greater than that of body portion 48 when formed into a ring about rotatable member 24. The configuration and composition of seal apparatus as described herein are such that lower face 78 of skirt 50 engages wearplate 46 sufficiently to provide a positive seal during rotation without any significant effect on the rotation of screen assembly 20.

Next, side screen 26 is slipped over seal apparatus 10 against outboard surface 56 until the lower edge of side screen 26 rests on shelf 70 as shown in FIG. 4. Hose clamp 80 is then installed and tightened about side screen 26 opposite outboard surface 56 and top screen 28 attached to side screen 26.

With engine 14 operating, radiator fan 18 induces air flow downwardly through screens 26, 28, through rotatable member 24 and through radiator 16. The air movement over blades 36 induces rotation of rotatable member 24 and thereby screen assembly 20. With seal apparatus 10 in place, the wiping engagement between skirt 50 and wearplate 46 allows rotation of screen assembly 20 while providing a positive seal thereby avoiding the problems of the prior art.

Those skilled in the art will appreciate that the present invention encompasses many variations in the preferred embodiment described herein.

Having thus described the preferred embodiment of the present invention, the following is claimed as new and desired to be secured by Letters Patent:

1. A seal apparatus for providing a positive seal between the rotatable member of a rotatable air inlet screen assembly of an agricultural vehicle and a contact surface of the agricultural vehicle surrounding the rotatable member, said apparatus comprising:

a unitary strip of air impervious, flexible resilient material, said strip presenting opposite ends and having a length sufficient for circumscribing the rotatable member when the ends are placed into a contiguous relationship with one another, said strip including a body portion presenting a generally inwardly facing inboard surface configured to sealingly engage the rotatable member, and a generally outwardly projecting skirt extending the length of the body portion and presenting a sealing face, said skirt being flexed in a manner that causes the sealing face to be brought into wiping engagement with the contact surface when the strip is placed in circumscribing relationship about the rotatable member with the ends in the contiguous relationship.

2. The apparatus as set forth in claim 1 said strip including a transition section between said body portion and said skirt.

3. The apparatus as set forth in claim 2 said body portion including an upper portion and a lower portion, said transition section extending from said lower portion.

4. The apparatus as set forth in claim 3, said skirt extending outwardly from said transition section.

5. The apparatus as set forth in claim 2 said body portion including an upper portion and a lower portion and presenting an outer face, said transition section extending from said lower portion, said skirt extending outwardly from said transition section at an angle of about 95° relative to said outer face.

6. The apparatus as set forth in claim 5, said skirt flexing at an angle of between about 105° and 110° relative to said outer face upon placement of said strip in circumscribing relationship with the rotatable member of the vehicle with the ends in the contiguous relationship.

7. The apparatus as set forth in claim 1, said strip being composed of EPDM rubber.

8. The apparatus as set forth in claim 7, said strip being composed of 60 durometer rubber.

9. The apparatus as set forth in claim 1, the vehicle including a self-propelled farm machine.

10. In combination:

a farm machine including a rotatable air inlet screen assembly having a rotatable member and including a contact surface surrounding said rotatable member; and a seal apparatus coupled with said rotatable member for rotation therewith and including a body portion circumscribing said rotatable member and presenting an inboard surface, a disk-shaped skirt circumscribing said body portion and presenting a lower face, and a transition section between said body portion and skirt, said body portion, skirt and transition section being integrally composed of air impervious, flexible resilient material, said inboard surface of said body portion engaging and providing a positive seal with said rotatable member, said skirt flexing downwardly so that said lower face is in wiping engagement with said contact surface for providing a positive seal therewith.

11. The combination as set forth in claim 10, said body portion including an upper portion and a lower portion, said transition section extending from said lower portion.

12. The combination as set forth in claim 11, said skirt extending outwardly from said transition section.

13. The combination as set forth in claim 12, said seal presenting opposed ends, said skirt being flexed into contact with said contact surface upon placement of said body portion in circumscribing relationship with said rotatable member of said farm machine with said opposed ends abutting one another.

14. The combination as set forth in claim 10, said seal being composed of EPDM rubber.

15. The combination as set forth in claim 14, said seal being composed of 60 durometer rubber.

16. The combination as set forth in claim 10, said body portion including an upper portion and a lower portion and presenting an outer face, said transition section extending from said lower portion, said skirt extending outwardly from said transition section at an angle of between about 105° and 110° relative to said outer face into wiping engagement with said contact surface for providing a positive seal therewith.

* * * * *